US006209301B1

(12) United States Patent
Baader et al.

(10) Patent No.: US 6,209,301 B1
(45) Date of Patent: Apr. 3, 2001

(54) TEXTURING MACHINE

(75) Inventors: Uwe Baader; Thomas Wortmann, both of Wuppertal (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 09/463,505

(22) PCT Filed: May 14, 1999

(86) PCT No.: PCT/EP99/03316

§ 371 Date: Feb. 28, 2000

§ 102(e) Date: Feb. 28, 2000

(87) PCT Pub. No.: WO99/61690

PCT Pub. Date: Dec. 2, 1999

(30) Foreign Application Priority Data

May 22, 1998 (DE) ..... 198 22 885

(51) Int. Cl.[7] ..... D01H 5/28

(52) U.S. Cl. ..... 57/280; 57/332

(58) Field of Search ..... 57/279, 280, 332, 57/333, 334, 328, 350, 290, 291, 348, 349, 352, 356, 78; 28/241, 242, 248, 272

(56) References Cited

U.S. PATENT DOCUMENTS 3,772,869 * 11/1973 Mutschler et al. ..... 57/106
4,058,961 * 11/1977 Kubler ..... 57/34 HS
4,581,884 * 4/1986 Brough ..... 57/291
5,431,002 * 7/1995 Treptow ..... 57/280
5,896,976 * 4/1999 Jaschke ..... 57/280
5,924,272 * 7/1999 Jaschke et al. ..... 57/279

FOREIGN PATENT DOCUMENTS 196 52 620 6/1997 (DE) .
0 571 974 12/1993 (EP) .

* cited by examiner

*Primary Examiner*—Amy B. Vanatta
(74) *Attorney, Agent, or Firm*—Alston & Bird LLP

(57) ABSTRACT

A texturing machine is described which consists of a plurality of processing-points for thermoplastic threads. A feed bobbin, a first delivery mechanism, an elongated first heating device, an elongated cooling device, a false-twist unit, a second delivery mechanism and also a winding-up device are arranged at each processing-point. In this connection several feed bobbins are arranged above one another in a creel frame, and several winding-up devices are arranged above one another in a winding frame. The first delivery mechanism, the heater and the cooling device are located above the frames. In order to guarantee a careful course of the thread as well as operability, the first delivery mechanism is arranged together with a drive in an operational position directly upstream of the inlet of the first heating device. In this connection it is possible, with a view to piecing a thread, for the first delivery mechanism with or without the drive to be adjusted in its location into an operating position below the operational position in such a way that the delivery mechanism is not capable of being driven in the operating position.

18 Claims, 6 Drawing Sheets

Figure 1:
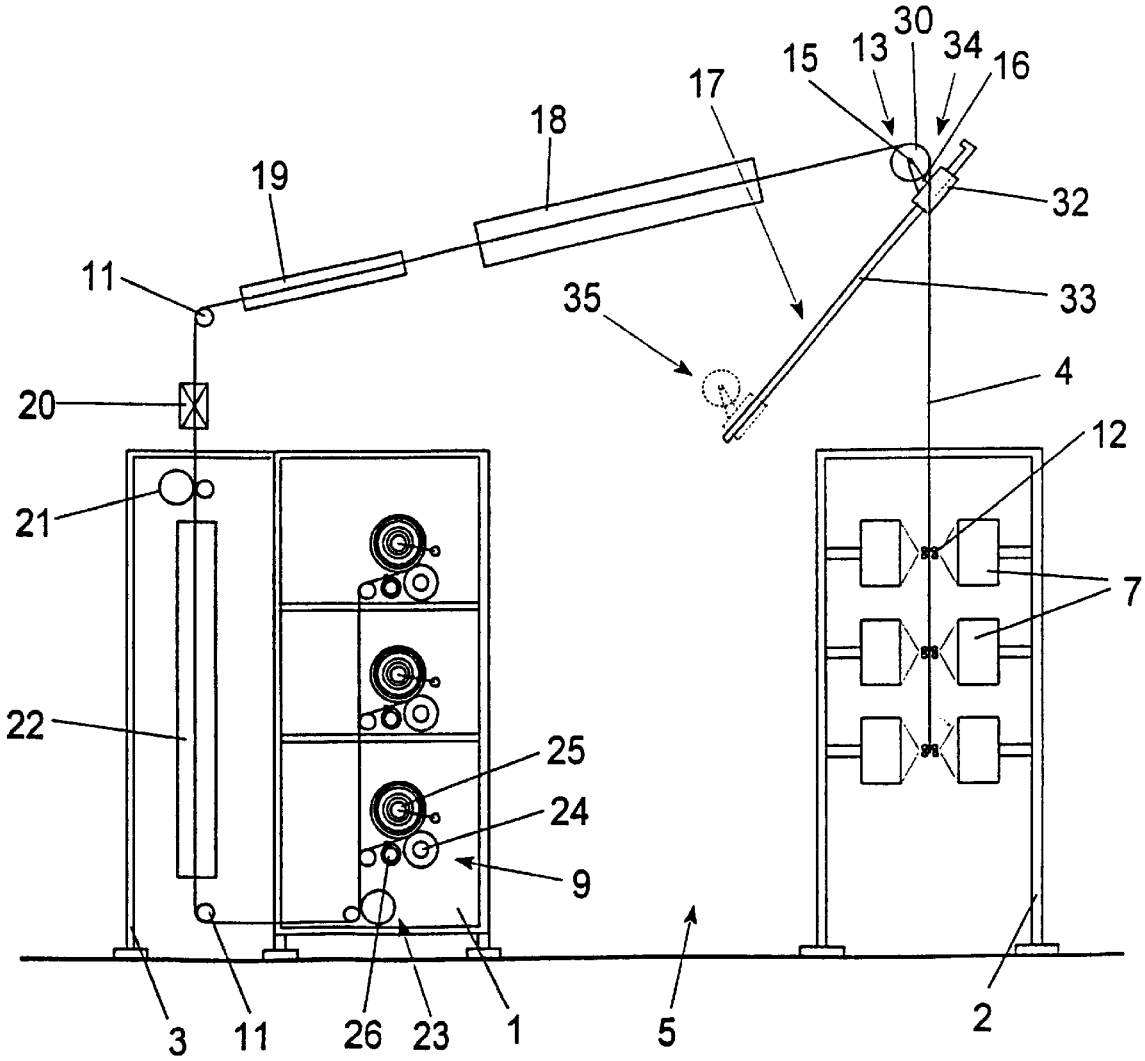

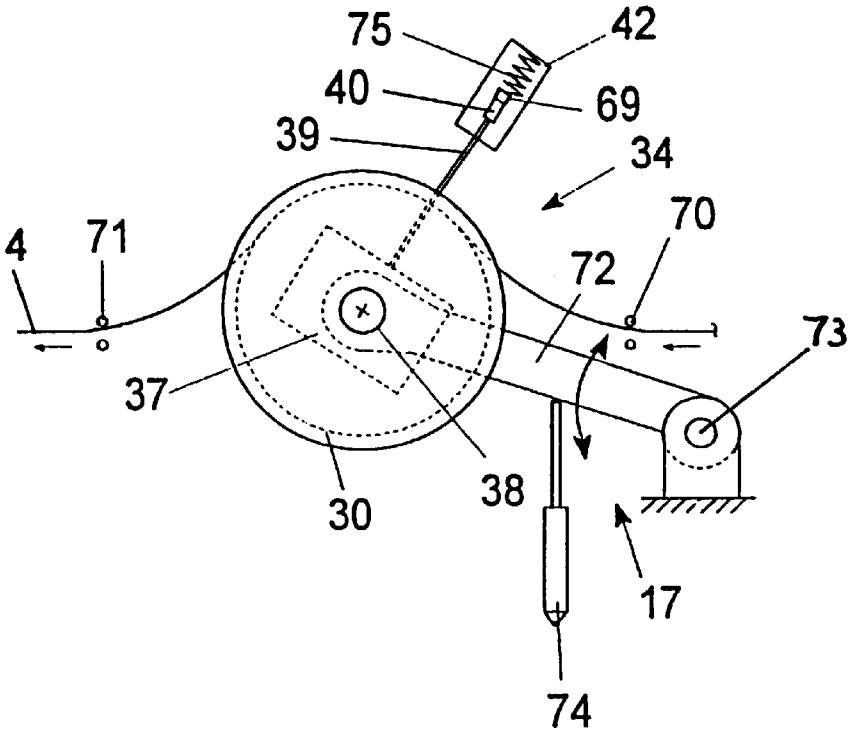
Fig.3.2
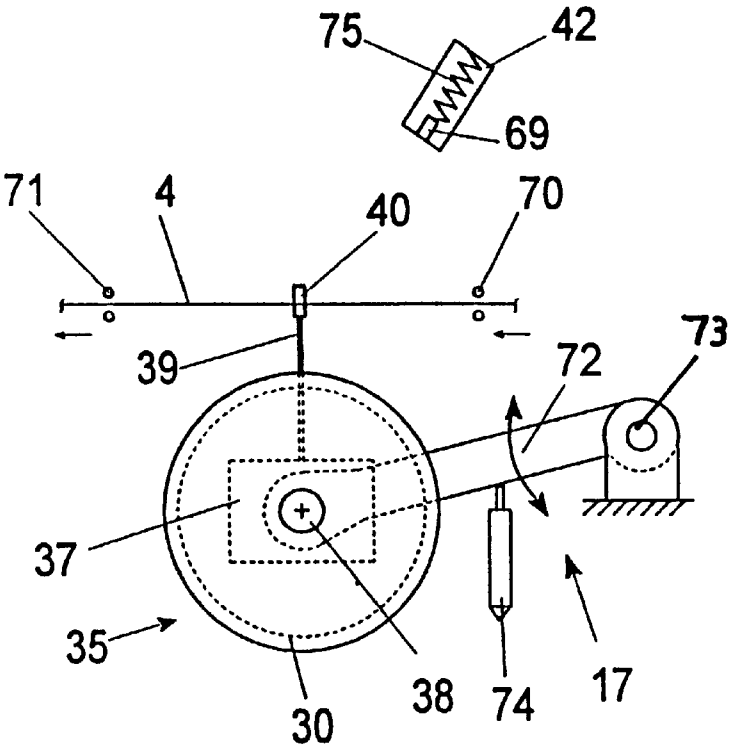
Fig.3.1

TEXTURING MACHINE

BACKGROUND OF THE INVENTION

The present invention relates to a false twist texturing machine for texturing a plurality of advancing thermoplastic yarns.

The known texturing machine comprises a creel frame and a winding frame. In the creel frame several feed bobbins are arranged above one another which each make available a thread for a processing-point. Above the creel frame a first delivery mechanism is arranged, in order to draw off the thread from the feed bobbin and to convey it into a false-twist texturing zone. In the false-twist texturing zone an elongated heating device and an elongated cooling device are arranged in alignment in series above the frame. By virtue of this arrangement, extreme deflections result in the line of thread between the feed bobbin and the inlet of the heater, which make careful processing of the yarn impossible. Furthermore, the arrangement of the delivery mechanism above the creel frame results in operating problems, particularly in the process of piecing the thread.

An object of the invention is consequently to design a texturing machine of the type specified in the introduction in such a way that careful processing of the yarn and therefore higher texturing speeds can be achieved.

A further objective of the invention is to create a texturing machine with which the thread can be pieced in simple manner also in the case of a multi-tier construction of the machine.

SUMMARY OF THE INVENTION

The above and other objects and advantages of the present invention are achieved by a yarn false twist texturing machine which comprises a frame assembly which mounts a feed bobbin, a first yarn delivery mechanism, an elongate first heater, an elongate cooling device, a false twist unit, a second delivery device, and a wind up device. The first heater and the cooling device are positioned at an elevated location, preferably above the frame assembly, and the first delivery mechanism is mounted for generally vertical movement between a raised operational position directly upstream of the first heater, and a lowered operating or thread up position. A drive is provided for rotatably driving the first delivery mechanism is the raised position, and the drive is disconnected when it is in the lowered operating position.

The texturing machine according to the invention is distinguished, first of all, by the fact that the delivery mechanism is arranged directly upstream of the inlet of the first heater. By this means a deflection-free line of thread between the delivery mechanism and the heater is brought about. The tensile force of the thread that is set with a view to stretching within the false-twist zone between the first delivery mechanism and the second delivery mechanism can be set without significant friction losses. The particular advantage of the texturing machine according to the invention, however, is that, with a view to piecing the thread, the delivery mechanism is capable of being vertically adjusted into an operating position below the operational position, in which operating position the delivery mechanism is not driven. In the process of piecing the thread, the thread coming from the feed bobbin is guided by the operator with a suction pistol. In the operating position the operator consequently brings the thread up close to the delivery mechanism with the aid of a suction pistol. The speed of the line of thread is determined by the suction pistol. No conveying action takes place by means of the delivery mechanism, so no differences in speed can arise. In the operating position the thread glides over the conveying means of the delivery mechanism. Rolls or rollers may be employed by way of conveying means in this connection. If, for example, pressure rollers or pressure belts are employed, the clamping between the pressure rollers or between the pressure belts and the roll is firstly set in the operational position, in order to enable the thread to glide. Activation of the delivery mechanism may, for example, be brought about in simple manner by means of a final-position circuit with the aid of a contact switch.

The vertical adjustment of the delivery mechanism may be effected in the case of the texturing machine according to the invention with or without the delivery mechanism being driven. In the case where the drive is capable of being moved jointly with the delivery mechanism out of the operational position into the operating position, the invention provides a solution with which the drive in the operational position is connected in coupling manner to a power-supply connector. Depending on the configuration of the drive, it is consequently possible for the power supply to be established by means of a mechanical coupling or an electrical plug contact as a result of connection between a power source and the drive.

In a particularly advantageous further development of the texturing machine according to the invention the delivery mechanism takes the form of a conveyor roller which is driven by an electric motor. The motor is connected in the operational position to an electrical power supply by means of a plug. By virtue of a design of this type it is possible for each processing-point to be operated individually. In particular in the process of piecing the thread, each processing-point can be operated independently of the adjacent processing-point.

In the case where the delivery mechanism takes the form of a conveyor roller the thread is guided on the periphery of the conveyor roller in a zigzag-shaped thread-line track. For this purpose the conveyor roller comprises a plurality of guide elements on the periphery which bring about a deflection of the thread substantially at right angles to the direction of the line of thread. In the event of rotation of the conveyor roller the thread is conveyed in non-slipping manner by reason of the friction between the guide elements and the thread. In addition to the deflection of the guide elements, the thread has to partially wrap around the conveyor roller to a certain extent. This partial wrapping is achieved in the operational position, so that in the operational position the drive of the conveyor roller has to apply a correspondingly high driving torque. With a view to accelerating the conveyor roller it is therefore particularly advantageous if the texturing machine comprises a power-supply connector with a mobile plug contact which, together with the corresponding plug, results in current being supplied to the motor a short time before the operational position is reached and hence brings about a start-up of the delivery mechanism a short time before the operational position is reached.

A particularly preferred construction of the texturing machine according to the invention provides for the drive to be arranged so as to be fixed in the operational position, while the delivery mechanism is able to be coupled to the drive or uncoupled from it in the operational position. This arrangement has the advantage that control of the drive is thereby possible independently of the location of the delivery mechanism.

The configuration of the delivery mechanism in the form of a conveyor roller is particularly advantageous also in the case of a fixed drive. The connection between the electric motor and the conveyor roller in this case is ensured in the operational position by means of a magnetic coupling. This magnetic coupling may consist, for example, of two magnetised discs which form an air gap between them. The magnetic discs possess alternating magnetic polarities in the peripheral direction, so that a rotary motion can be transmitted. These coupling discs are fastened frontally to the rotor of the motor and to a hub of the conveyor roller.

In a particularly advantageous design of the texturing machine the pick-out mark is placed directly in the driving magnetic field of the motor. To this end the rotor is constructed so as to be capable of being displaced out of the motor together with the conveyor roller. The linkage between rotor and stator is effected via magnetic forces. Hence a wear-free connection between the drive and the delivery mechanism is possible. The stationary part of the motor is arranged so as to be fixed in the operational position. The moving part of the motor, on the other hand, is displaceable. With a construction of this type the element of a coupling is eliminated. A further advantage is that the conveyor roller can be arranged directly on the rotor.

In order to enable a coupling or uncoupling of the rotor with or from the motor, where possible with a direction of motion in which the delivery mechanism is capable of being moved, the further development of the texturing machine in which an air gap extending at right angles to the axis of rotation of the rotor is formed between the stator and the rotor is particularly advantageous. For this purpose the stator comprises a winding that generates a magnetic field aligned parallel to the axis of rotation of the rotor. In the coupled state the stator and the rotor are situated axially opposite one another and form the air gap between them. For the purpose of uncoupling, the rotor is displaced together with the conveyor roller in the direction of the air gap. In this connection the transverse force acting on the rotor is greater than the magnetic force acting between the motor and the rotor.

In order to be able to transmit a high torque to the delivery mechanism, in another embodiment of the texturing machine the rotor of the motor is formed from an axle and a plate. The conveyor roller is fastened at one end of the axle. The plate is fastened frontally at the opposite end of the axle. The plate is formed in such a way that when the stator is situated opposite it a torque is generated on the rotor. The stator and the circular plate of the rotor are preferably constructed to be rotationally symmetrical.

In the case where the plate consists of a magnetisable material and comprises an induction plate made of aluminium or copper on the side facing the stator, the motor can be operated advantageously as an asynchronous machine. By virtue of the magnetisable material of the plate the magnetic connection between the stator and the rotor is guaranteed. The induction plate serves as a squirrel cage and is consequently responsible for the production of torque.

With a view to improving the efficiency of the motor it is possible for the induction plate to be realised by means of several evenly distributed indentations.

In another construction the plate is formed from a plurality of permanent magnets which are arranged with one pole in a plane in heteropolar manner relative to one another. This configuration enables a commutated drive of the motor.

In the case where an amortisseur is arranged frontally in the plate between the poles the motor can also be operated as a normal synchronous machine. In this case it would be an advantage that several motors are able to be controlled by means of a frequency converter.

The function of the motor is also guaranteed in the case of a partial overlap between stator and rotor. In this case the air gap which is formed between the stator and the rotor should cover at least an angular range of 90°, but at most 360°. The partial overlap between stator and rotor has the advantage that the stator and the rotor may be designed differently.

For instance, the stator may be U-shaped, with the plate of the rotor being displaceably sunk between the legs of the U. In this case an air gap forms on each side of the plate between stator and rotor.

In principle, however, in the case of a partial overlap of 180° there is also the possibility of constructing the stator and the rotor, according to an advantageous further development, in radial arrangement relative to one another. For this purpose the stator comprises a winding that generates a magnetic field aligned at right angles to the axis of rotation of the rotor. Between the stator and the rotor an air gap consequently forms extending parallel to the axis of rotation of the rotor.

In order that the coupling and the transmission are capable of being Implemented reproducibly in the operational position with uniform quality after each piecing, in a particularly advantageous further development of the texturing machine the delivery mechanism is run against a stop in the operational position. This stop may be arranged on the machine frame or on an adjusting device by means of which the delivery mechanism is moved.

In a particularly advantageous further development of the texturing machine a thread-guide is arranged in the line of thread both upstream of and downstream of the delivery mechanism. In this case the delivery mechanism and the thread-guides are positioned relative to one another in such a way that the thread does not wrap around the delivery mechanism in the operating position or only wraps around it slightly. Consequently, the wrapping of the thread on the delivery mechanism that is necessary for conveying the thread is only achieved in the operational position. After being pieced, first of all the thread is guided substantially by the thread-guide. Only at the transition of the delivery mechanism from the operating position into the operational position does the thread arrive at the engagement region of the delivery mechanism.

With a construction of this type there is even the possibility of the delivery mechanism being arranged so as to be fixed and of the thread-guides being of adjustable design with a power-supply connector between an operating position and an operational position.

With a view to vertical adjustment of the first delivery mechanism, an adjusting device is advantageously employed with which the delivery mechanism is adjusted by a linear movement or by a pivoting movement out of the operating position into the operational position and vice versa. For this purpose the adjusting device comprises pneumatic or electrical drive means, in order to bridge the difference in distance between the operating position and the operational position.

The construction of the texturing machine in which the delivery mechanisms pertaining to a processing-point are capable of being driven by individual drives is distinguished in particular by the fact that piecing is capable of being carried out in a manner that affords particular protection to the yarn. In this case the drives pertaining to a processing-point can firstly be driven at the same speed, so that no stretching forces act on the thread. Only after the thread has been inserted in all the delivery mechanisms as far as the winding-up arrangement are the rotational speeds of the delivery mechanisms set that are necessary for operation.

In principle, the individual drives or the delivery mechanisms with the individual drives may be designed to be capable of being varied in their operational positions, in order, for example, to piece the thread on delivery mechanisms that are placed in an operationally unfriendly environment of the machine. With a view to piecing the thread, the delivery mechanism is moved in simple manner into an operating position.

BRIEF DESCRIPTIONS OF THE DRAWINGS

Figure 2:
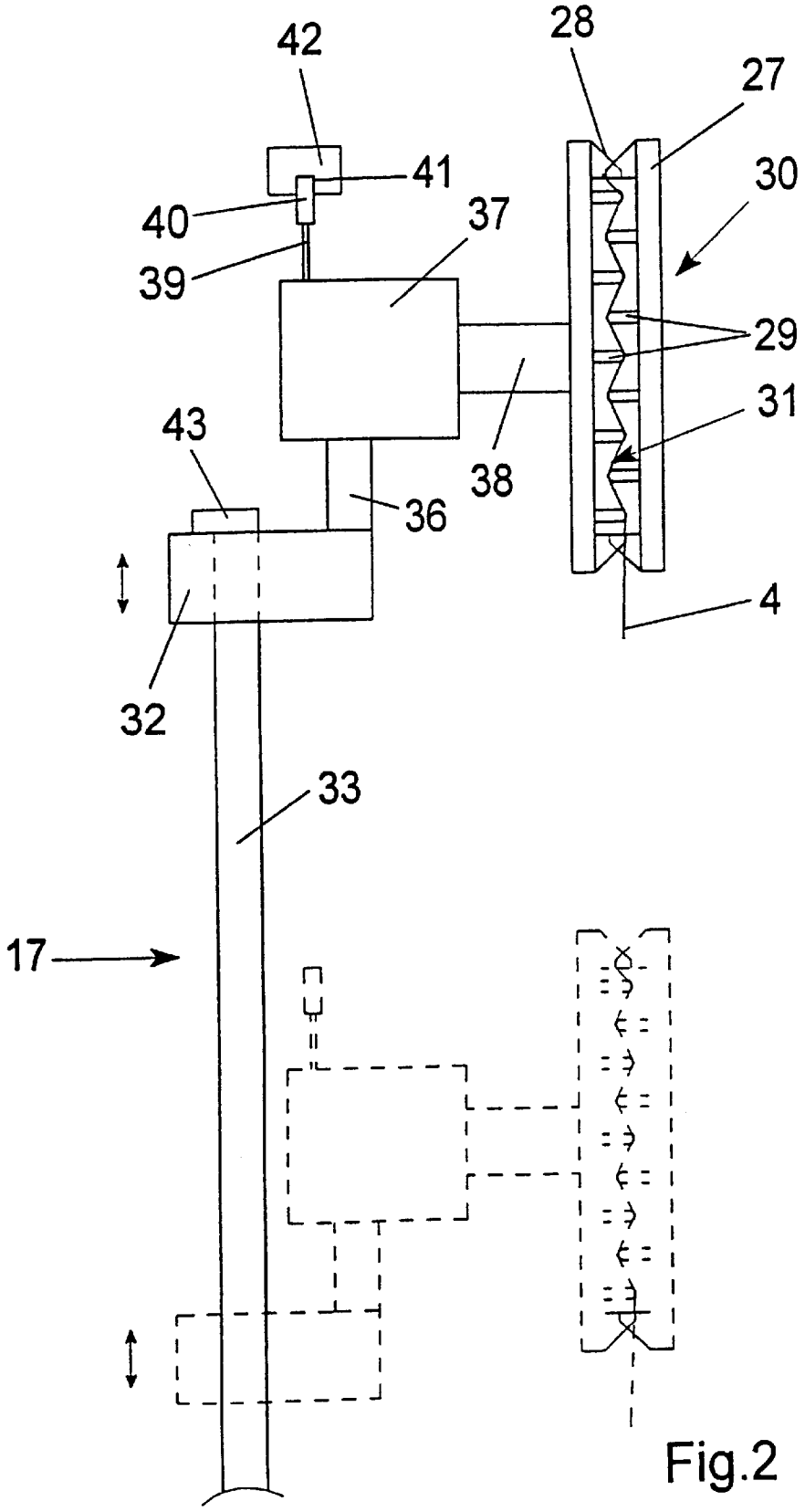
Figure 4:
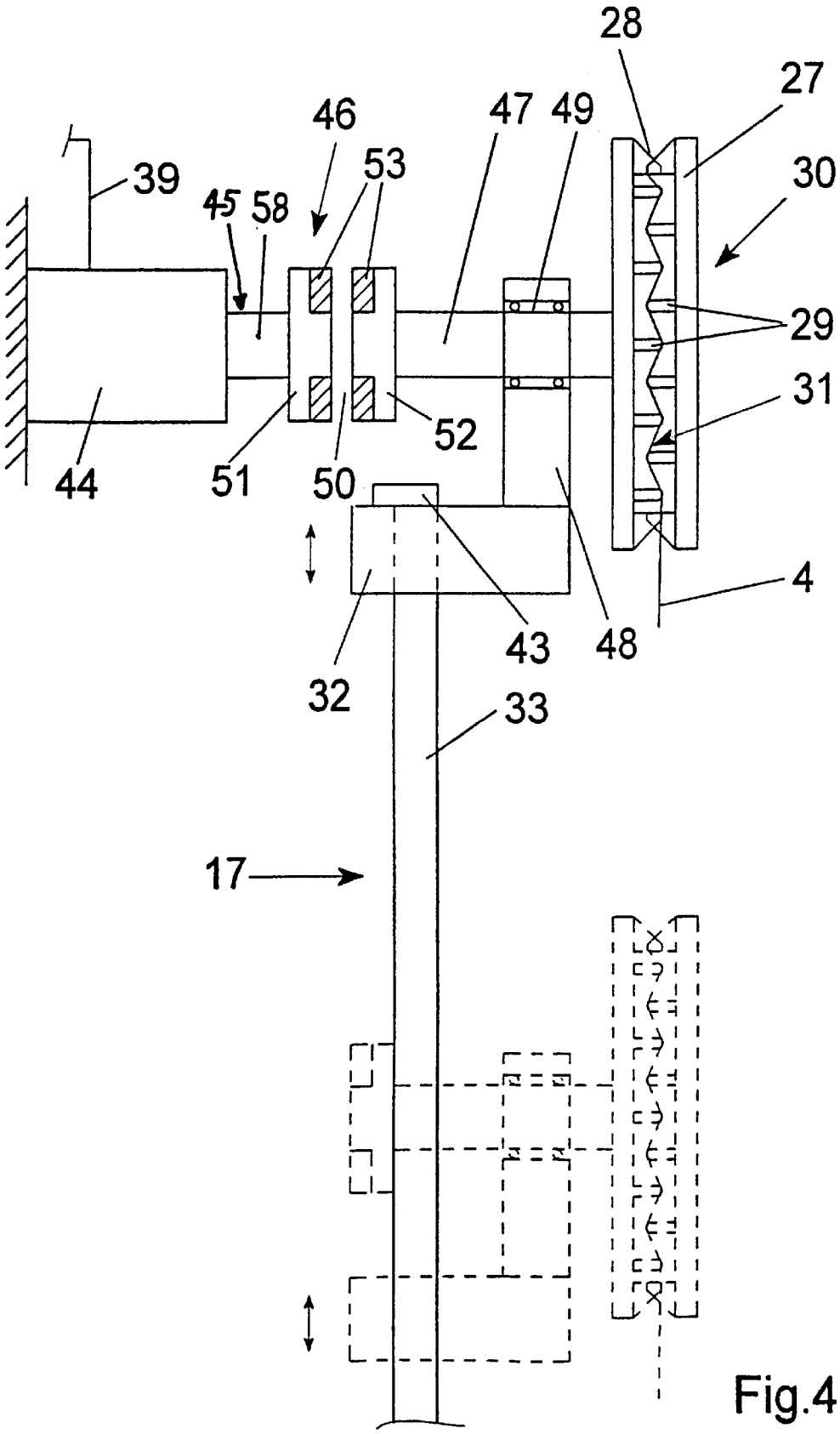
Figure 5:
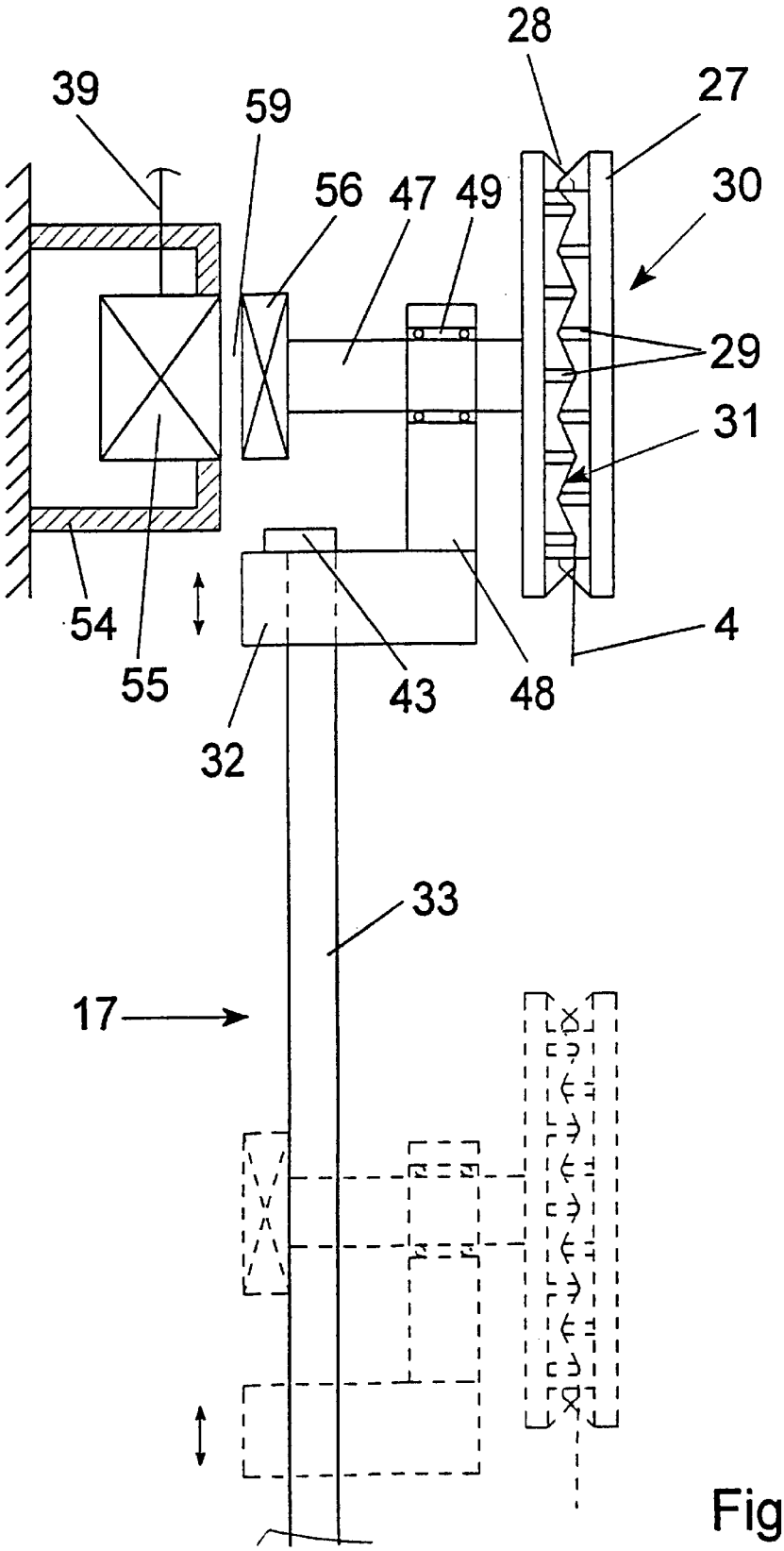
Figure 8:
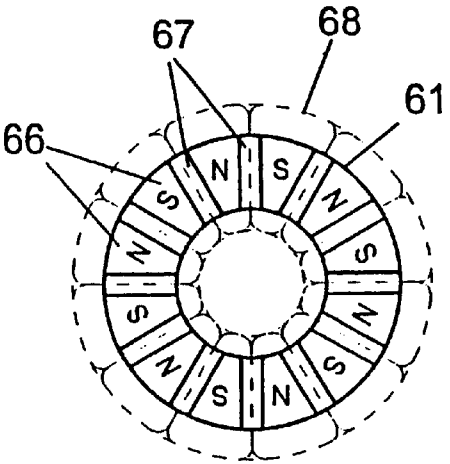
Figure 7:
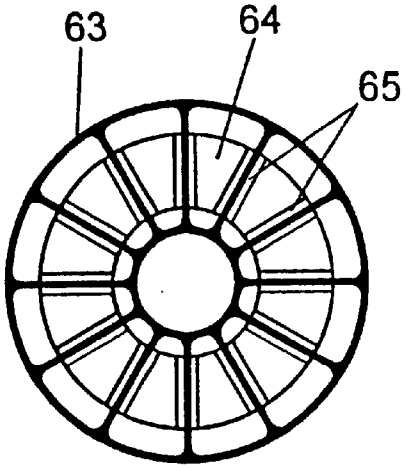
Figure 6:
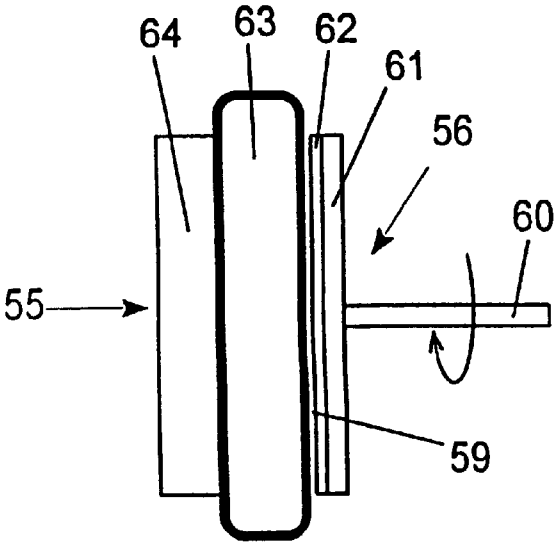

Some of the objects and advantages of the present invention having been stated, others will appear as the description proceeds, when considered in conjunction with the accompanying drawings, in which:

FIG. 1 a schematic view of a texturing machine according to the invention;

FIG. 2 a first embodiment example of a vertically adjustable delivery mechanism;

FIG. 3 to FIG. 5 further embodiment examples of a vertically adjustable delivery mechanism;

FIG. 6 schematically, a view of an electric drive with displaceable rotor;

FIG. 7 schematically, a top view of the stator of the electric drive from FIG. 5;

FIG. 8 schematically, a top view of an embodiment example of a displaceable rotor.

DETAILED DESCRIPTION OF THE PREFERRED EMBODIMENTS

An example of an embodiment of a texturing machine according to the invention is shown in FIG. 1. In this Figure one half of a partially automatic false-twist texturing machine is represented. Since both halves of the machine are fitted onto one another in mirror-image manner, only one half of the two-fold machine is shown in FIG. 1 and described.

The machine comprises a creel frame 2 and a winding frame 1. Arranged on one side of the winding frame 1 is a process frame 3 for receiving a second heater 22. In the creel frame 2 several feed bobbins 7 are arranged above one another in tiered manner. An operating/doffing passage 5 is formed between the creel frame 2 and the winding frame 1. Above the machine frame the first delivery mechanism 13, the heating device 18 and the cooling device 19 are arranged in a plane. A false-twist unit 20 and a second delivery mechanism 21 are supported on the process frame 3. The process frame 3 is arranged on the side of the winding frame 1 located opposite the creel frame 2. The winding frame 1 and the process frame 3 are directly joined to one another. In the process frame 3 a second heater 22 is arranged below the second delivery mechanism 21. The winding frame 1 serves to receive the winding-up devices 9. In this connection several winding-up devices are once again arranged above one another in tiered manner. In each of the winding-up devices the thread is wound to form a thread bobbin 25. The thread bobbin 25 is arranged on a spindle which is driven via a friction roller 24. Upstream of the thread bobbin a traversing device 26 is inserted in the line of thread.

With this arrangement the first delivery mechanism 13 is formed by a conveyor roller 30 such as is known from DE 196 52 620 (Bag. 2359). To this extent, reference is made to this printed publication at this point. The conveyor roller 30 is fastened with a drive (not represented here) to a vertically adjustable slide 32 pertaining to an adjusting device 17. In the adjusting device 17 the slide 32 can be moved along a guide 33 between the operational position 34 and an operating or thread up position 35 arranged below the operational position 34.

With this arrangement the thread 4 is guided to the conveyor roller 30 in the straight line of thread by the top thread-guides 12 of the creel frame 2 and arrives from there at the false-twist zone of the machine. The false-twist zone is delimited by the false-twist unit 20 and the conveyor roller 30. Within the false-twist zone the heating device 18 and the cooling device 19 are arranged in a plane. At the outlet of the cooling device 19 the false-twisted thread arrives at the false-twist unit 20 via a deflecting roller 11. The second delivery mechanism 21 moves the thread out of the false-twist zone into the second heater 22 which is connected downstream. From there the thread arrives at the winding-up device 9 via a third delivery mechanism 23. In the winding-up device 9 the thread is then wound to form a thread bobbin 25. After the bobbins 25 have been fully wound, the change of bobbins is carried out on the false-twist texturing machine by means of a doffer. For this purpose the full bobbins are taken out of the winding-up device and new empty tubes are installed. During this time the thread is taken up by means of a suction device and is guided to a waste container.

In the case of the texturing machine represented in FIG. 1 the second heater 22 and the third delivery mechanism 23 are employed for the purpose of enabling after-treatment of the thread. In this so-called set zone the thread is given the possibility of shrinking. To this end the delivery speed of the second delivery mechanism 21 is set higher than the delivery speed of the third delivery mechanism 23.

In the course of the production of yarns that are not subjected to after-treatment, the texturing machine represented in FIG. 1 is employed without the second heater 22 and without the third delivery mechanism 23. In this case the thread arrives directly at the winding-up device 9 from the second delivery mechanism 21. In both cases a speed difference is set between the first delivery mechanism 13 and the second delivery mechanism 21, in order to stretch the thread in the false-twist zone.

With a view to piecing a thread at a processing-point, the thread 4 is taken up via a manually guided suction pistol. An operator introduces the thread into the individual processing stations. To this end the first delivery mechanism 13 is guided into the lower operating position by means of the adjusting device 17. In the operating position 35 the delivery mechanism 13 is not driven. The thread consequently glides over the surfaces of the conveyor at the suction speed. In the case of the conveyor roller 30 which is employed, with which the thread is guided on a peripheral surface in a zigzag shape, the thread glides over the guide elements on the periphery of the conveyor roller. After the thread has been pieced, the delivery mechanism 13 is moved out of the operating position 35 into the operational position 34 by means of the adjusting device 17. In the operational position 34 an activation of the drive is effected, for example by means of a contact switch in the operational position, so that the thread 4 is conveyed by the delivery mechanism 13. Activation of the delivery mechanism 13 in the operational position 34 may also be carried out in another way, as described below.

The texturing machine shown in FIG. 1 is given by way of example with regard to its frame structure. The creel frame 2, the winding frame 1 and the process frame 3 may be combined in various ways. It is possible for a further operating passage to be formed between the process frame 3 and the winding frame 1. Similarly it is possible for the machine to be moved out in fully automated manner, so that the change of bobbins is effected automatically in the machine. The second delivery mechanism 21 and the third delivery mechanism 23 are represented in FIG. 1 as pressure-roller delivery mechanisms, the thread being clamped between a driven shaft and at least one roller which is arranged so as to be freely rotatable on the periphery of the shaft. However, the delivery mechanisms 21 and 23 may also take the form of conveyor rollers with an individual drive, corresponding to the first delivery mechanism 13.

A first embodiment example of the first delivery mechanism such as can be employed in the texturing machine from FIG. 1 is shown in FIG. 2. The delivery mechanism is constituted by a conveyor roller 30. Such delivery mechanisms are known from DE 196 52 620, to the content of which reference is made at this point.

The conveyor roller 30 takes the form of a disc 27 in the embodiment example shown in FIG. 2. The disc 27 has a U-shaped groove 28 on the periphery. In the U-shaped groove 28 several guide elements 29 are arranged alternately at the bottom of the groove in such a way that a zigzag-shaped line of thread 31 arises on the periphery of the disc 27 at the bottom of the groove. The conveyor roller 30 is firmly coupled to a drive shaft 38 which is driven by the electric motor 37. The motor 37 comprises a rigid lead 39, at the free end of which a plug 40 is arranged. In the operational position shown in FIG. 2 the plug 40 is connected to an electrical supply connector 41. The supply connector 41 is fitted in a supply lead 42. The supply lead 42 is arranged in the machine in the form of a strip and, with a view to the transmission of power, holds ready a supply connector for each processing-point for the purpose of coupling a drive. To this end the supply lead 42 is linked to a power source.

The delivery mechanism shown in FIG. 2 is located in the operational position. The motor 37 is connected to a source of current via the plug contact between the supply connector 41 and the plug 40. The drive shaft 38 is driven in rotation, so that the conveyor roller 30 conveys a thread 4 which is inserted in the thread-line track 31. The overlaps of the guide elements 29 of the conveyor roller 30 are so designed that the friction generated on the thread 4 prevents the thread from slipping on the peripheral surface of the disc 27. Consequently the thread 4 is given a speed that is predetermined by the rotational speed of the conveyor roller 30. With a view to controlling the electric motor 37 the control signals are likewise supplied to the motor via the plug connection.

The motor 37 is fastened via a support 36 to a vertically adjustable slide 32 pertaining to the adjusting device 17 according to FIG. 1. The vertically adjustable slide 32 is guided along a guide 33. It is possible for the slide 32 to be adjusted in its position along the guide 33 via a drive (not shown here). In this connection the drive may be formed by a cable pull or by a pneumatic linear drive. In the position shown in FIG. 2 the slide 32 is located in the operational position. In this connection the slide 32 bears against a stop 43 which is formed on the end of the guide 33. In this position the plug 40 is coupled to the supply connector 41.

If, with a view to piecing a thread, the drive of the slide 32 is now activated, an uncoupling takes place between the plug 40 and the supply connector 41. The slide 32 moves with the delivery mechanism into an operating position The conveyor roller 30 is no longer driven by the motor 37 after the plug connection has been uncoupled. When a thread is being pieced, the thread 4 will consequently slip over the guide surfaces of the disc 27 or will drive the conveyor roller 30 in rotation as a result of friction. The speed of the thread in the process of piecing is determined exclusively by the manually guided suction device. In FIG. 2 the uncoupled state of the delivery mechanism is represented by dashed lines.

Another embodiment example of a delivery mechanism is represented schematically in FIGS. 3.1 and 3.2. The delivery mechanism is shown in FIG. 3.1 in the operating position 35 and in FIG. 3.2 in the operational position 34. To the extent that nothing is stated to the contrary, the following description applies to FIGS. 3.1 and 3.2.

The delivery mechanism takes the form of a conveyor roller 30, and the structure and function of the conveyor roller 30 are identical to those of the conveyor roller from FIG. 2. To this extent, reference is made to the description relating to FIG. 2. The conveyor roller 30 is connected to a motor 37 via a drive shaft 38. The motor 37 comprises a plug 40 at the end of a rigid lead 39.

The drive shaft 38 is rotatably supported at the end of a rocker 72 between the motor 37 and the conveyor roller 30. The rocker 72 pertains to an adjusting device 17, by means of which the delivery mechanism is pivoted out of the operating position 35 into the operational position 34. To this end the rocker 72 of the adjusting device 17 is supported on the opposite end on a fixed pivotal axis 73. A pivot drive 74 engages the rocker 72. By activation of the pivot drive 74 it is possible for the conveyor roller 30 to be pivoted out of the operating position (FIG. 3.1) into the operational position (FIG. 3.2). In this connection the plug 40 comes into contact with a plug contact 69 pertaining to the power-supply connector 42. The plug contact 69 is held in the power-supply connector 42 via a spring 75. The spring 75 acts in the direction of motion of the plug 40. This ensures that when the pivot drive 74 is activated the plug 40 finds its way into the plug contact 69 just before the actual operational position of the delivery mechanism is reached. As a result, the power supply of the motor 37 is already established before the operational position is reached. The conveyor roller is accelerated and, when it reaches the operational position represented in FIG. 3.2, already has the requisite peripheral speed for conveying the thread 4.

The thread 4 is guided by the thread-guides 70 and 71. The thread-guide 70 is arranged in the line of thread upstream of the delivery mechanism and the thread-guide 71 is arranged in the line of thread downstream of the delivery mechanism. In the situation represented in FIG. 3.1 it is possible for the thread 4 to be pieced into the thread-guides 70 and 71 without the conveyor roller 30 being wrapped around by the thread. The thread 4 and the conveyor roller 30 are located in a plane. By means of the adjusting device 17 the conveyor roller 30 is guided from the transition out of the operating position 35 into the operational position 34 into the line of thread between the thread-guides 70 and 71. In the process the thread 4 is taken up by the conveyor roller and automatically finds its way into the thread-line track on the periphery of the conveyor roller 30. Only when it reaches the operational position 34 does the thread 4 have the minimum wrap on the periphery of the conveyor roller 30 determined by the thread-guides 70 and 71, so that the thread is conveyed by the conveyor roller 30 without slipping.

The embodiment example represented in FIGS. 3.1 and 3.2 may also be employed by way of second or third delivery mechanism in the texturing machine represented in FIG. 1. In particular, the handling in the process of piecing the thread can thereby be improved.

Another embodiment example of a first delivery mechanism is shown in FIG. 4. The first delivery mechanism takes the form of a conveyor roller 30. The structure and the function of the conveyor roller 30 are identical to those of the conveyor roller from FIG. 2. To this extent, reference is made to the description relating to FIG. 2. The conveyor roller 30 is fastened to a hub 47. The hub 47 is connected at a protruding free end to a magnetic disc 52 pertaining to a magnetic coupling 46. Between the magnetic disc 52 and the conveyor roller 20 the hub 47 is supported by the bearing 49 on a support 48. The support 48 is firmly connected to a vertically adjustable slide 32. The slide 32 is connected to a drive (not shown here) and can be adjusted in its position along the guide 33.

In the position of the conveyor roller 30 shown in FIG. 4 a second magnetic disc 51 pertaining to the magnetic coupling 46 is located opposite the magnetic disc 52 which is fastened to the hub 47. A vertical air gap 50 is formed between the two magnetic discs 51 and 52. The magnetic discs 51 and 52 comprise, on their opposing surfaces, several magnets 53 which are arranged with magnetic polarity alternating in the peripheral direction. The magnetic disc 51 of the magnetic coupling 46 is fastened to the free end of a rotor shaft 58 of an electric motor 44. The electric motor 44 is arranged so as to be fixed on a machine frame. For the supply of power and for control, the motor 44 is connected to a control unit via the lead 39.

In the position of the delivery mechanism shown in FIG. 4 the conveyor roller 30 is driven. To this end the rotation of the rotor shaft 58 is transmitted to the hub 47 by the magnetic coupling 46. The conveyor roller 30 is driven at the rotational speed determined by the motor 44. It is possible for the magnetic coupling 46 to be uncoupled in simple manner by displacement of one of the magnetic discs along the plane of the air gap. Consequently the conveyor roller 30 can be moved out of the operational position in simple manner by means of the slide 32. The uncoupled state of the delivery mechanism is represented in FIG. 3 by a dashed line.

Another embodiment example of a delivery mechanism that is capable of being coupled is represented in FIG. 5. The design of the conveyor roller 30 and of the adjusting device 17 are identical to that of the embodiment example from FIG. 4. Reference is made at this point to the description pertaining to FIG. 4.

In the embodiment example shown in FIG. 5 the free end of the hub 47 is connected to a rotor 56. In the operational position which is shown the rotor 56 is situated opposite a stator 55. The stator 55 is connected to a machine frame via a housing 54. Via the lead 39 the stator is provided with power and with control pulses. A narrow air gap 59 is formed between the stator 55 and the rotor 56. In order to drive the rotor 56 in rotation, the stator 55 is designed in such a way that the stator generates a magnetic field parallel to the axis of rotation of the rotor. This design enables the coupling-point to be placed directly between the stator 55 and the rotor 56. Hence the rotor 56 is capable of being coupled and uncoupled by lateral displacement, so that the conveyor roller 30 is capable of being varied in its position by activation of the slide 32. The uncoupled state of the delivery mechanism is represented in FIG. 4 by a dashed line.

A first embodiment example of an electric drive with a rotor that is capable of being laterally displaced is shown in FIGS. 6 and 7. A side view of a stator 55 and a rotor 56 is represented schematically in FIG. 6. The rotor 56 consists of an axle 60 which is firmly connected at one end to a plate 61. It is possible for a conveyor roller to be fastened directly to the opposite free end of the axle 60. The plate 61 is produced from a magnetisable material. An induction plate 62 made of aluminium or of copper is fitted on the side of the plate 61 facing away from the axle 60. The stator 55 is located opposite, spaced from the induction plate 62. The stator 55 comprises a winding 63 on the front face facing the induction plate 62. As represented in FIG. 7, the winding 63 is inserted in grooves 65 pertaining to a pack of laminated sheets 64. The winding 63 is formed in this case by numerous individual windings with axial winding direction. In this connection the winding 63 may be formed from several winding packages. By virtue of such an arrangement an axially aligned magnetic field is generated by the stator 55. An air gap 59 is formed between the winding and the induction plate. The air gap 59 extends in a plane perpendicular to the axis of rotation of the rotor. When current is supplied to the stator 55 a magnetic field is generated which results in magnetisation of the plate 61. Hence a magnetic linkage between the stator and the rotor is guaranteed. The electric drive takes the form of a three-phase motor, so that the magnetic field in the induction plate 62 generates a torque that results in rotation of the rotor 56. With this arrangement the electric drive takes the form of an asynchronous machine. In order to increase the efficiency of a machine of this type, the induction plate 62 is provided with indentations, so that, for example, a spoked-wheel lattice is formed.

In order to operate an electric drive of this type as a synchronous machine it is possible for the rotor 56 —as represented schematically in FIG. 8—to be moved out. A top view of the front face of the rotor 56 is shown in FIG. 8. In this case several permanent magnets 66 are arranged in annular manner on the plate 61. The magnets 66 are formed with alternate poles in the peripheral direction. In order to adapt the speed between the rotary field and the rotor, an amortisseur, for example in the form of a spoked-wheel construction, may be inserted in the grooves 67.

At this point it should be mentioned expressly that the invention is not restricted solely to delivery mechanisms that are driven by means of individual drives. It is entirely possible for adjacent delivery mechanisms to be driven via a common drive. In this case, for example, adjacent delivery mechanisms are moved jointly into their operational position and are coupled to the drive only after the thread has been pieced.

The embodiment examples relating to a drive with displaceable rotor are given here by way of examples. Further constructions could be formed by the rotor not being covered by the stator over 360°. A partial overlap of 90°, for example, between stator and rotor would enable a driving transmission for a conveyor roller. Similarly, the opposing arrangement of stator and rotor on the front face is exemplary. In the event of partial overlap, the stator and the rotor could be designed in such a way that an air gap extends parallel to the axis of rotation. In this case, however, the overlap between the rotor and the stator cannot be greater than 180°, in order to guarantee a displacement of the rotor.

What is claimed is:

1. A yarn false twist texturing machine comprising a frame assembly which mounts a feed bobbin, a first delivery mechanism, an elongate first heater, an elongate cooling device, a false twist unit, a second delivery mechanism, and a wind up device so that a yarn may be guided serially therebetween, and with said first heater and said cooling device being mounted at an elevated location, wherein said first delivery mechanism is mounted for generally vertical movement between a raised operational position directly upstream of the first heater and a lowered thread up position, and a drive for rotatably driving the first delivery mechanism when said first delivery mechanism is in said raised operative position and which is disconnected when said first delivery mechanism is in said lowered thread up position.

2. The texturing machine according to claim 1 wherein said drive comprises an electric motor mounted to said first delivery mechanism so as to move therewith, and said motor includes a coupler for engaging a power supply connector when said first delivery mechanism is in said raised operational position.

3. The texturing machine according to claim 2 wherein said first delivery mechanism comprises a conveyor roller.

4. The texturing machine according to claim 3 wherein the motor coupler is configured so as to engage the power supply connector and receive electrical power a short distance before the raised operational position is reached.

5. The texturing machine according to claim 1, wherein the drive is mounted so as to be fixed adjacent the operational position, and wherein the drive is capable of being coupled to the first delivery mechanism in the operational position.

6. The texturing machine according to claim 5, wherein the drive is an electric motor, and the delivery mechanism is a conveyor roller which is driven by a rotor of the motor, and wherein the rotor and the conveyor roller are connected to one another in the operational position by means of a magnetic coupling.

7. The texturing machine according to claim 5, wherein the drive is an electric motor, and the delivery mechanism is a conveyor roller which is connected to a rotor of the motor, and wherein the rotor and the conveyor roller are capable of being displaced from a stator of the motor, and whereby the rotor is capable of being magnetically connected to the stator of the motor.

8. The texturing machine according to claim 7, wherein the stator comprises a winding which generates a magnetic field aligned parallel to the axis of rotation of the rotor and where the stator and the rotor are situated axially opposite one another, so that an air gap which extends at right angles to the axis of rotation of the rotor is formed between the stator and the rotor.

9. The texturing machine according to claim 8, wherein the rotor is connected to an axle and a plate arranged at right angles to the axle, and the axle is connected at one end to the conveyor roller and at the opposite end to the plate, and wherein the plate is constructed in such a way that when the stator is located opposite it a torque is generated on the rotor.

10. The texturing machine according to claim 9, wherein the plate comprises a magnetisable material and comprises on the side facing the stator an induction plate made of aluminium or copper, which induction plate has several evenly distributed indentations.

11. The texturing machine according to claim 9, wherein the plate comprises a plurality of permanent magnets which are arranged with one pole in a plane in heteropolar manner relative to one another and where an amortisseur is arranged between the poles of the permanent magnets.

12. The texturing machine according to claim 8, wherein the air gap which is formed between the stator and the rotor extends over an angular range from 90° to 360° in relation to the axis of rotation of the rotor.

13. The texturing machine according to claim 7, wherein the stator comprises a winding which generates a magnetic field aligned at right angles to the axis of rotation of the rotor and where the stator and the rotor are opposite one another, so that an air gap which extends parallel to the axis of rotation of the rotor is formed between the stator and the rotor.

14. The texturing machine according to claim 1, wherein in the operational position the first delivery mechanism bears against a stop.

15. The texturing machine according to claim 1, wherein a thread-guide is arranged both upstream of and downstream of the first delivery mechanism and where the first delivery mechanism and the thread-guides are positioned relative to one another in such a way that the yarn partially wraps around the first delivery mechanism in the operating position.

16. The texturing machine according to claim 1, wherein an adjusting device is provided for vertical adjustment of the first delivery mechanism, whereby the first delivery mechanism is adjusted by a linear movement or a pivoting movement out of the operating position into the thread up position and vice versa.

17. A yarn false twist texturing apparatus comprising a frame assembly comprising a processing frame, a creel positioned on one side of the processing frame for supporting a plurality of yarn feed bobbins, and a winding frame, a plurality of side by side false twist imparting units mounted to said frame assembly for imparting false twist to each of a plurality of advancing yarns, with each of the false twist imparting units comprising a feed bobbin mounted in said creel, a first delivery mechanism, an elongate first heater, an elongate cooling device, a false twist unit, a second delivery mechanism, and a wind up device mounted in said winding frame so that a yarn may be guided serially therebetween, and with said first heater and said cooling device being mounted above said frame assembly, wherein said first delivery mechanism is mounted for generally vertical movement between a raised operational position directly upstream of the first heater and a lowered thread up position, and a drive for rotatably driving the first delivery mechanism when said first delivery mechanism is in said raised operative position and which is disconnected when said first delivery mechanism is in said lowered thread up position.

18. The yarn false twist texturing apparatus according to claim 17 wherein the drive of each of the twist imparting units is separate from the drive of the remaining units.

* * * * *